United States Patent [19]

Henke et al.

[11] 4,117,045

[45] Sep. 26, 1978

[54] HUMIDIFIER WITH REMOVABLE WATER RECEPTACLE

[75] Inventors: Fred G. Henke, West Bend; Carl R. Spoeth, Jr., Kewaskum, both of Wis.

[73] Assignee: Dart Industries Inc., Los Angeles, Calif.

[21] Appl. No.: 725,805

[22] Filed: Sep. 23, 1976

[51] Int. Cl.[2] ..... B01F 3/04

[52] U.S. Cl. ..... 261/30; 261/92; 312/107; D6/167; D23/146; D87/1 R

[58] Field of Search ..... 261/30, 91, 92, DIG. 46, 261/DIG. 15, 24, 28, 80, DIG. 14; 312/107, 111, 198; 206/505-507; D6/167, 168; D23/143, 146, 149; D87/1 R

[56] References Cited

U.S. PATENT DOCUMENTS

| | | | |
|---|---|---|---|
| 2,417,126 | 3/1947 | Richards | 261/91 |
| 2,554,868 | 5/1951 | Mills | 261/91 X |
| 2,584,618 | 2/1952 | Robic | 261/92 |
| 2,742,181 | 4/1956 | Jarund | 206/507 |
| 3,323,784 | 6/1967 | Fazio | 261/DIG. 46 |
| 3,471,133 | 10/1969 | Sherwood | 261/91 |
| 3,595,269 | 7/1971 | Yeagle | 261/92 X |
| 3,598,370 | 8/1971 | Hoag | 261/92 X |
| 3,610,589 | 10/1971 | Paulin | 261/30 |
| 3,628,312 | 12/1971 | Stoop et al. | 261/92 X |
| 3,730,497 | 5/1973 | Schmitt et al. | 261/92 X |
| 3,979,485 | 9/1976 | Hoag | 261/92 X |
| 4,027,796 | 6/1977 | Martin | 206/507 |

FOREIGN PATENT DOCUMENTS

| | | | |
|---|---|---|---|
| 2,359,476 | 6/1975 | Fed. Rep. of Germany | 261/92 |

*Primary Examiner*—Richard L. Chiesa
*Attorney, Agent, or Firm*—Kenneth J. Hovet

[57] ABSTRACT

A humidifier having an outer housing with a top opening covered with a removable top member. A power chassis and a rotatable drum having a web of water absorbent material about its circumference are mounted within the housing and are each removable through the top opening. A removable water container is located within the housing below the drum. The container is readily cleaned or replaced by lifting it out of the housing through the top opening.

6 Claims, 6 Drawing Figures

HUMIDIFIER WITH REMOVABLE WATER RECEPTACLE

BACKGROUND OF THE INVENTION

1. Field of the Invention

The present invention relates to humidifiers and, more particularly, to humidifiers having removable component parts.

2. Description of the Prior Art

Humidifier manufacturers have long sought to provide a simplified minimum maintenance device that will withstand the effects of "hard" water. "Hard" water generally connotes water having calcium and magnesium salts which tend to form encrustments on materials in contact with the water — especially during the evaporation thereof which occurs in a humidifier.

In the typical humidifying device, water is transported from a reservoir by a porous medium and ambient air is passed through the medium to evaporate and entrain the water. The moisture-laden air created thereby is circulated about a room or the like. When the reservoir water has a measure of hardness, the reservoir sidewalls and porous medium often become heavily encrusted with calcium and magnesium deposits.

Prior art devices such as that shown in U.S. Pat. No. 3,471,133 provide for removal of the rotating drum for ease of cleaning. However, the water reservoir is a permanent part of the humidifier and one must reach into the housing to clean and/or sponge out residual water. This, of course, is a difficult and cumbersome procedure.

SUMMARY OF THE INVENTION

An essential advantageous feature of the humidifier disclosed herein is the ability to remove the water container from within the outer housing. Handle means are included for lifting the container out of the housing and positioning means are provided for locating the container at a predetermined position within the housing.

DESCRIPTION OF A PREFERRED EMBODIMENT

Figure 1:
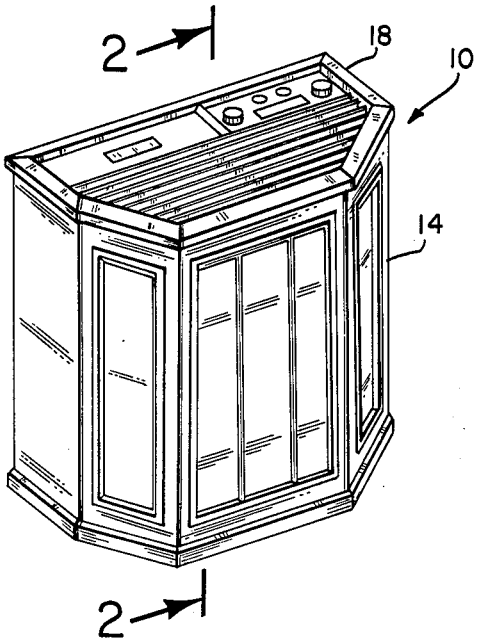
FIG. 1 is a front perspective view of the humidifier of the present invention.

Referring now to various figures of the drawings, it will be seen that reference numeral 10 indicates generally an improved humidifier embodying the principles of the invention. The humidifier is provided with a decorative housing 14 having a top opening 16 which is covered by a removable top member 18. The humidifier housing is provided with a bottom wall 22 which supports a water container or reservoir 24.

Removably mounted within the housing above the container is power chassis 30. It will be understood that for purposes of the present invention, the power chassis is a unitary self contained assembly containing a power source, a fan and a drive means for a purpose to be hereinafter described. Additionally, the power chassis includes control switches, a humidistat and all electrical components typically associated with a household humidifier.

Mounted adjacent the power chassis is rotatable drum 34. The drum is open on the side directly adjacent the fan and closed with an end wall 38 on the opposing side. The periphery is provided with spaced-apart ribs 37 over which is secured a web 39 of water absorbent material. The inside surface of rim 36, which defines the open side of the drum, is mounted upon a drive means 40 and bearing means 41, both extending from the power chassis 30. Frictional engagement between the drive means and inner rim surface serve to rotate the drum about its central longitudinal axis.

When the above-described component parts of the humidifier are assembled, the lower portion of the drum 34 will be partially within the container 24. As such, it can be seen that as the drum rotates the web of water absorbent material will be progressively immersed into water contained within the reservoir. As the drum continues to rotate, water will be conveyed out of the reservoir and into contact with an air stream created by the fan means. (The flow of air is best shown by the arrows depicted in FIG. 2). The air, of course, flows through the interstices of the web and vaporizes and entrains the water contained therein for circulation about a room. The air flow may be directed as it passes through the slotted top member 18 by louvers or the like.

It will be appreciated that the essential distinguishing feature of the present invention is the water container 24 which is an independent component of the humidifier and separable therefrom. The container is provided with lifting means shown in the drawings as handles 46. The handles are formed integral with the sidewalls 48 of the container. However, known means such as detachable handles, knobs, slotted sidewalls, or overhanging rim structure that would allow one to grasp the container and remove it would be suitable for purposes of the present invention.

Figure 2:
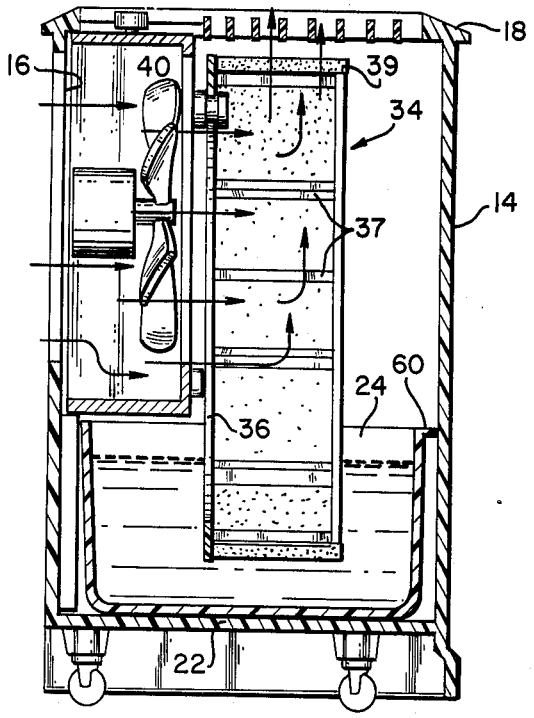
FIG. 2 is an elevational view taken along lines 2—2 of FIG. 1.
Figure 3:
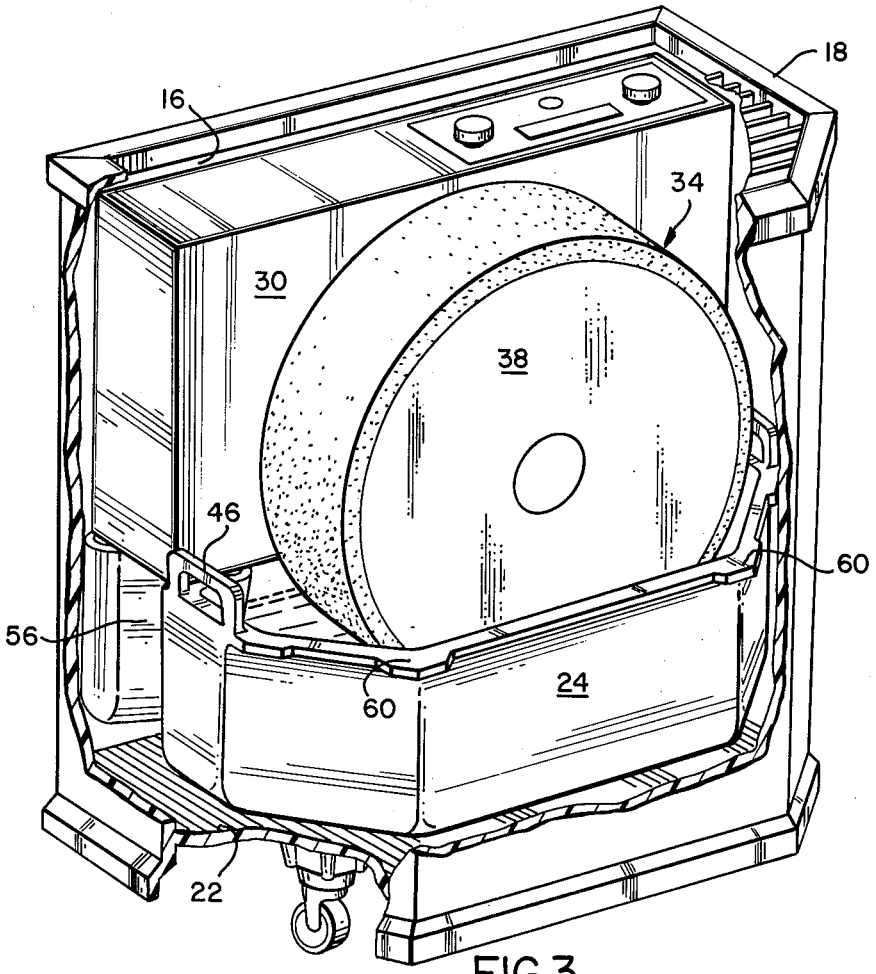
FIG. 3 is an enlarged perspective view partially broken-away of the humidifier of FIG. 1.

It can be seen that the outline of the container generally conforms to the configuration of the housing sidewalls. Of course, it is necessary that the top opening of the container be dimensioned to allow for the insertion of a portion of the drum 34. When the container is filled with water, as depicted in FIG. 2, it will be appreciated that the container must be securely positioned within the housing so that it will be stable during filling and/or movement of the humidifier. To effect this objective, the container is provided with positioning means which cooperate with projection means extending inwardly from the housing to securely position and locate the container at a predetermined location within the housing. In the preferred embodiment, the sidewalls 48 are indented to engage housing locator blocks 52. The blocks 52 project inwardly from the housing sidewalls and engage matching indentations shown by reference numeral 56 of the container.

The aforementioned positioning means may further include container top edge extensions shown by reference numeral 60. These extensions are dimensioned to abut against the housing sidewall while the back wall of the container abuts against an opposing housing sidewall. In this manner, the container will be prevented from sliding about the housing.

Figures 4, 5, 6:
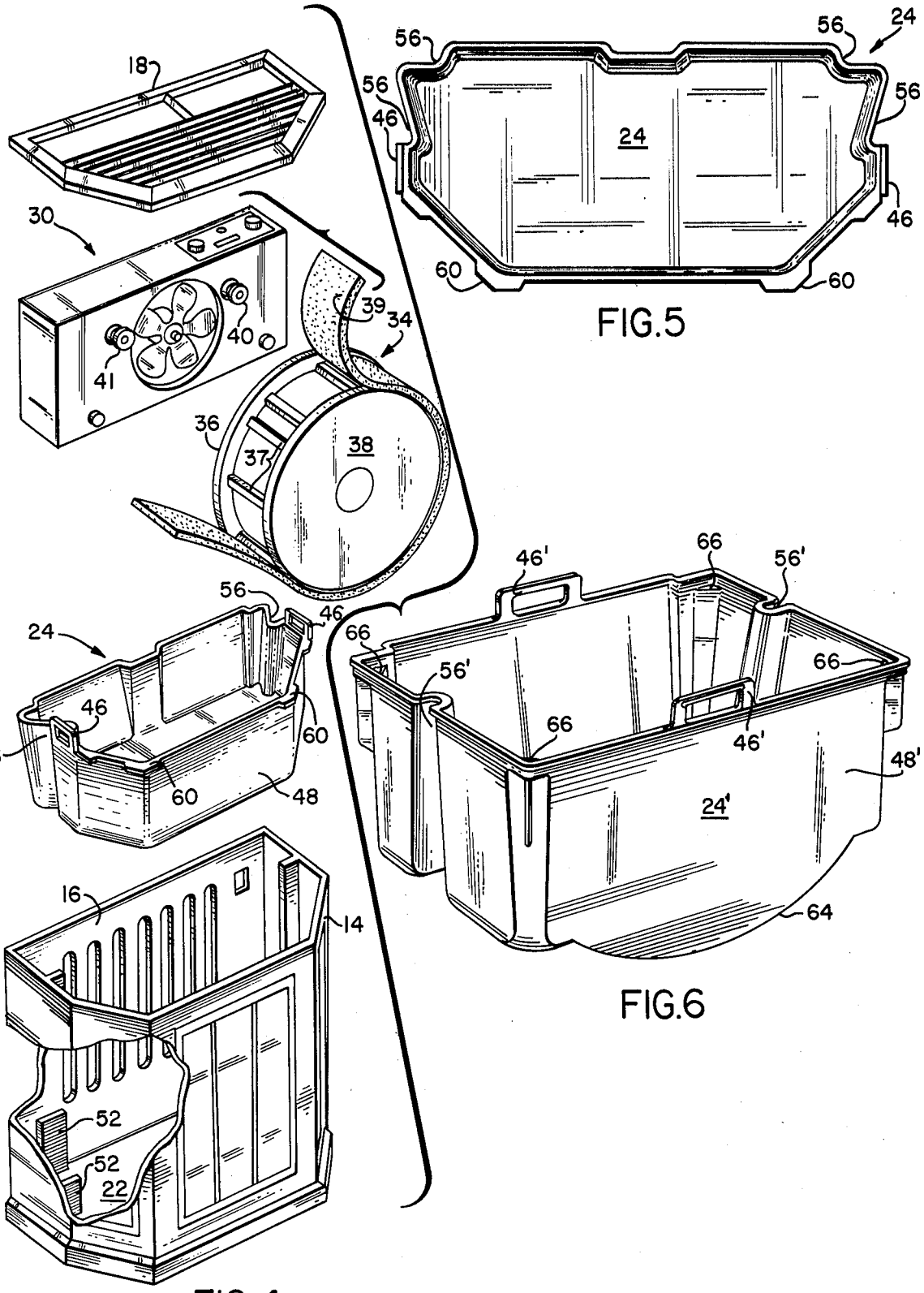
FIG. 4 is an exploded view of the inner removable parts of the humidifier of FIG. 1 including a partial broken-away view showing the interior of the outer housing.
FIG. 5 is a top plan view of the water reservoir shown in FIGS. 2, 3 and 4.
FIG. 6 is an alternative water reservoir adapted for use with the present invention.

Referring now to FIG. 6, an alternative embodiment of the container 24' is shown. In this embodiment the bottom 64 of the container is concave in shape and conforms to a corresponding concave shape of the housing bottom (not shown). Such a curved bottom when used in conjunction with sidewall indentations 56', which match corresponding projections in the housing (not shown) in the manner previously described, serve to facilitate the stable positioning of the container within the housing.

An additional feature provided with the water container of the present invention is the use of visual indicating means that allows one to clearly determine when the reservoir is full of water. In the preferred embodiment, the visual water level indicating means can take the form of shelves shown by reference numeral 66. One or more of the shelves may be located along the sidewall(s) or corner(s) of the container. The shelf members extend inwardly a predetermined distance from an upper portion of the container sidewalls 48' and are offset downwardly a distance from the container top edge sufficient to inhibit overflow. It may be advantageous to imprint on the horizontal top surface of the shelf the letters "Full" or the like in a bright color so that the user, when looking down into the housing, will have a clear indication of when the reservoir is full.

While the humidifier has been described with respect to particular preferred embodiments, it will be understood that various modifications and improvements may be made without departing from the spirit and scope of the invention. Accordingly, it is to be understood that the invention is not to be limited by the specific illustrative embodiments, but only by the scope of the appended claims.

We claim:

1. A humidifier having an outer housing enclosing a removable power chassis and a removable rotating open-ended drum having a ribbed periphery covered by a peripheral water absorbent material said power chassis containing a power source connected to a fan by drive means, said drum located adjacent said fan whereby air is directed by the fan into said drum and out the periphery thereof through said absorbent material, said housing including interior projection means extending inwardly and a (removable) water reservoir removable from said housing and supported thereby having upstanding sidewalls defining a top opening dimensioned for insertion of a portion of said drum, said sidewalls being indented to cooperatingly engage the projection means for locating the reservoir at a secure predetermined position within the housing beneath said drum, and said sidewalls further including lifting means for removing said reservoir through an opening at the top of said housing.

2. The humidifier of claim 1 wherein said reservoir includes visual water level indicating means comprising at least one shelf member extending inwardly from a predetermined upper portion of said upstanding sidewalls adjacent said top opening.

3. The humidifier of claim 2 wherein said reservoir includes a concave reservoir bottom adapted to fit a corresponding concave bottom in said housing.

4. The humidifier of claim 1 wherein said reservoir includes handles attached to opposing sidewalls thereof.

5. The humidifier of claim 1 wherein the sidewalls of said reservoir includes top edge extensions dimensioned to abut against the housing.

6. The humidifier of claim 1 wherein the housing projection means comprises locater blocks.

* * * * *